US006152717A

United States Patent [19]

Morita et al.

[11] Patent Number: 6,152,717

[45] Date of Patent: Nov. 28, 2000

[54] INTERNAL GEAR PUMPS

[75] Inventors: Shoji Morita; Ikuo Misumi, both of Kanagawa, Japan

[73] Assignee: Unisia Jecs Corporation, Atsugi, Japan

[21] Appl. No.: 09/327,485

[22] Filed: Jun. 8, 1999

[30] Foreign Application Priority Data

Jun. 11, 1998 [JP] Japan ..... 10-163670
Jun. 11, 1998 [JP] Japan ..... 10-163671

[51] Int. Cl.[7] ..... F04C 18/00

[52] U.S. Cl. ..... 418/171; 418/166; 418/107

[58] Field of Search ..... 418/171, 166, 418/107

[56] References Cited

U.S. PATENT DOCUMENTS

| | | | |
|---|---|---|---|
| 2,389,728 | 11/1945 | Hill | 418/166 |
| 2,956,512 | 10/1960 | Brundage | 418/171 |
| 3,303,793 | 2/1967 | Morita | 418/166 |
| 4,177,025 | 12/1979 | Eisenmann et al. | 418/133 |
| 5,139,395 | 8/1992 | Kemmner . | |
| 5,144,325 | 9/1992 | Morita | 418/171 |
| 6,074,189 | 6/2000 | Eckerle | 418/166 |

FOREIGN PATENT DOCUMENTS

| | | | |
|---|---|---|---|
| 0 467 571 | 1/1992 | European Pat. Off. . | |
| 578962 | 10/1924 | France | 418/171 |
| 40 24 628 | 2/1992 | Germany . | |
| 43 15 432 | 11/1994 | Germany . | |
| 4-125687 | 11/1992 | Japan . | |
| 7-102928 | 4/1995 | Japan . | |
| 476515 | 12/1937 | United Kingdom | 418/171 |

*Primary Examiner*—Thomas Denion
*Assistant Examiner*—Theresa Trieu
*Attorney, Agent, or Firm*—Foley & Lardner

[57] ABSTRACT

An internal gear pump includes in a pump housing an outer rotor including an internal gear portion on the inner periphery, and an inner rotor being eccentrically disposed with respect to the outer rotor and including an external gear portion on the outer periphery that is engaged with the internal gear portion of the outer rotor. A side plate is integrated with the outer rotor to abut on a side of the inner rotor that fails to be in slide contact with the housing. A holding device is mounted to the pump housing to restrict a position of the outer rotor with respect to the housing.

7 Claims, 8 Drawing Sheets

INTERNAL GEAR PUMPS

BACKGROUND OF THE INVENTION

The present invention relates to internal gear pumps including an outer rotor and an inner rotor eccentrically engaged therewith.

As to internal gear pumps including an outer rotor having an internal gear portion on the inner periphery and an inner rotor having an external gear portion on the outer periphery and eccentrically engaged with the internal gear portion of the outer rotor, a reduction in leakage of hydraulic fluid through a slight clearance between a side of each rotor and a pump housing is an essential factor for improving the pump efficiency. Such leakage reduction is achieved by means of a structural contrivance shown, e.g. in JP-U 4-125687 or JP-A 7-102928.

JP-U 4-125687 discloses an internal oil pump including an outer rotor having an outer periphery rotatably held by rotor holding members screwed to a pump housing and an inner rotor held by a side plate formed with the outer rotor and the pump housing.

JP-A 7-102928 discloses an oil pump including outer and inner rotors accommodated in an oil-pump casing and held by the oil-pump casing and a rotary cover screwed thereto.

As to the internal oil pump disclosed in JP-U 4-125687, however, a plurality of rotor holding members need is to separately be disposed along the outer periphery of the outer rotor, requiring a lot of time for their assembling and adjusting.

As to the oil pump disclosed in JP-A 7-102928, singe the structure that the rotary cover is in slide contact with either side of each outer rotor and inner rotor involves greater friction, the rotary cover needs to be subjected to lightening working for friction reduction, resulting in the increased number of working processes.

It is, therefore, an object of the present invention to provide internal gear pumps with the reduced number of parts and working processes and smaller friction.

SUMMARY OF THE INVENTION

One aspect of the present invention lies in providing an internal gear pump, comprising:

a housing;

an outer rotor rotatably accommodated in said housing, said outer rotor including an internal gear portion on an inner periphery thereof;

an inner rotor rotatably accommodated in said housing, said inner rotor being eccentrically disposed with respect to said outer rotor, said inner rotor including an external gear portion on an outer periphery thereof, said external gear being engaged with said internal gear portion of said outer rotor;

a side plate integrated with said outer rotor, said side plate abutting on a side of said inner rotor, said side failing to be in slide contact with said housing; and a holding device mounted to said pump housing, said holding device restricting a position of said outer rotor with respect to said housing.

Another aspect of the present invention lies in providing an internal gear pump, comprising:

a housing;

an outer rotor rotatably accommodated in said housing, said outer rotor including an internal gear portion on an inner periphery thereof;

an inner rotor rotatably accommodated in said housing, said inner rotor being eccentrically disposed with respect to said outer rotor, said inner rotor including an external gear portion on an outer periphery thereof, said external gear being engaged with said internal gear portion of said outer rotor;

a side plate integrated with said outer rotor, said side plate abutting on a side of said inner rotor, said side failing to be in slide contact with said housing; and means, mounted to said pump housing, for restricting a position of said outer rotor with respect to said housing.

DETAILED DESCRIPTION OF THE INVENTION

Figure 1:
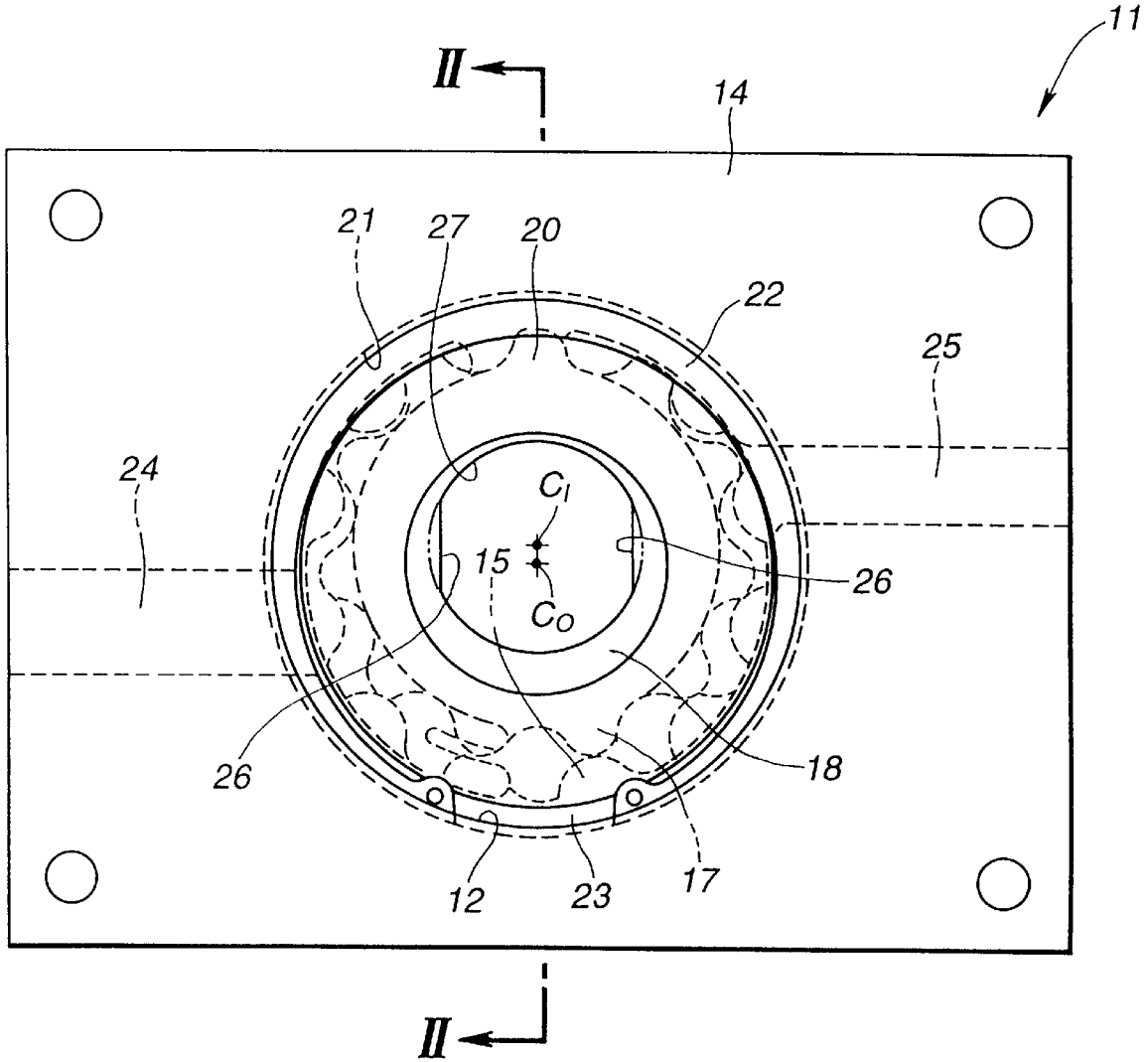
FIG. 1 is a front view showing a first embodiment of an internal gear pump according to the present invention.

Referring to the drawings wherein like reference numerals designate like parts throughout the views, a description will be made with regard to an internal gear pump embodying the present invention. In the embodiments, the inventive internal gear pump is applied to a lubricating oil feed pump.

Figure 2:
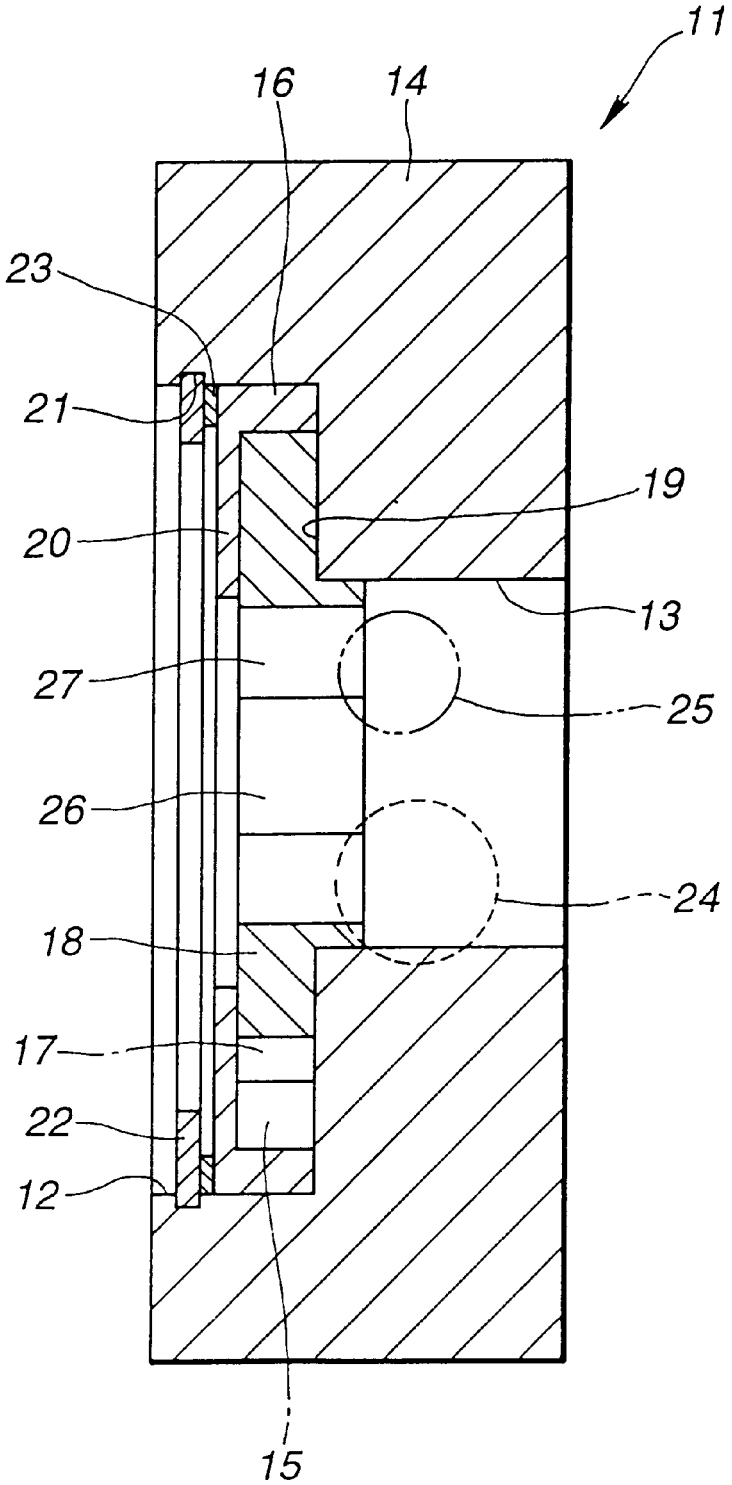
FIG. 2 is a sectional view taken along the line II—II in FIG. 1.

FIGS. 1–2 show a first embodiment of the present invention. Referring to FIGS. 1–2, an internal gear pump comprises a pump housing 11 through which a crankshaft of a vehicular engine, not shown, is arranged. The pump housing 11 comprises a pump body 14 formed with a stepped hole having a larger diameter portion 12 and a smaller diameter portion 13, and a pump cover, not shown, integrated with the pump body 14 by means of fixing screws, not shown. It is noted that the pump cover is not an essential member in the present invention, and a structure with no pump cover may be adopted.

Rotatably supported by the larger diameter portion 12 of the stepped hole is an outer rotor 16 having an internal gear portion 15 on the inner periphery. Rotatably supported by the smaller diameter portion 13 of the stepped hole eccentrically arranged with respect to the larger diameter portion 12 is an inner rotor 18 having an external gear portion 17 on the outer periphery, which is engaged with the internal gear portion 15 of the outer rotor 16. One side of each outer rotor 16 and inner rotor 17 abuts on a bearing surface 19 of the stepped hole. As is well known, the external gear portion 17 of the inner rotor 18 is smaller in the number of teeth than the internal gear portion 15 of the outer rotor 16. A rotation axis $C_O$ of the outer rotor 16 is eccentric to an rotation axis $C_I$ of the inner rotor 18 or the crankshaft.

Another side of the outer rotor 16 is integrally formed with an annular side plate 20 that can abut on another end face of the inner rotor 18. The inner rotor 18 is held by the side plate 20 and the bearing surface 19 of the stepped hole. An annular groove 21 is formed with the larger diameter portion 12 of the stepped hole at the open end. Engaged with the annular groove 21 is a snap ring or C ring 22 serving as an inventive holding member. An annular friction reducing member 23 comprising a coating layer of synthetic resin such as ethylene tetrafluoride resin, a thrust washer, and a thrust bearing is interposed between the outer rotor 16 and the snap ring 22. Appropriate setting of the thickness of the friction reducing member 23 allows the outer rotor 16 to be held in the pump body 14 by the snap ring 22 without any play with respect to the pump body 14 in the direction of the rotation axis $C_O$ A suction port 24 and a discharge port 25 for hydraulic fluid, i.e. lubricating oil in the first embodiment, are formed in the pump body 14 in the opposite direction with respect to a plane including the rotation axes $C_O$, $C_I$ of the outer and inner rotors 16, 18 and along an engaged portion of the outer and inner rotors 16, 18. An engagement hole 27 having a modified cross section corresponding to the crankshaft, i.e. having a pair of flat surfaces 26, is formed in the center of the inner rotor 18 engaged with the crankshaft for unitary rotation.

Therefore, when the inner rotor 16 is driven counterclockwise as shown in FIG. 1 through the crankshaft, the outer rotor 16 is driven together, which has the internal gear portion 15 engaged with the external gear portion 17 of the inner rotor 18. By this, lubricating oil within the suction port 24 is successively fed into the discharge port 25 through a clearance formed between the external gear portion 17 of the inner rotor 18 and the internal gear portion 15 of the outer rotor 16.

In that case, since the one side of each outer rotor 16 and inner rotor 18 are sealed by the bearing surface 19 of the pump body 14, and the another end face of the inner rotor 18 is sealed by the side plate 20 integrated with the outer rotor 16, pump action is preserved. Moreover, since the snap ring 22 contacts the side plate 20 of the outer rotor 16 through the friction reducing member 23 which serves to form some clearance between the snap ring 22 and the side plate 20, there cannot occur friction due to shearing of an oil film interposed between the two, etc. Even if the discharge pressure of lubricating oil becomes greater with an increase in rotation of the crankshaft, friction between the snap spring 22 and the outer rotor 16 is prevented from increasing by the friction reducing member 23 arranged therebetween.

In the first embodiment, the friction reducing member 23 is interposed between the snap ring 22 and the outer rotor 16. Alternatively, a friction reducing coating layer of synthetic resin such as ethylene tetrafluoride resin may be placed on at least one of the snap ring 22 and the outer rotor 16.

Moreover, in the first embodiment, the snap ring 32 as a holding member abuts on the outer rotor 16 on the outer periphery through the friction reducing member 23. Alternatively, the holding member may abut on the outer ring 16 on the inner periphery of the side plate 20 where the peripheral velocity is smaller.

Figure 3:
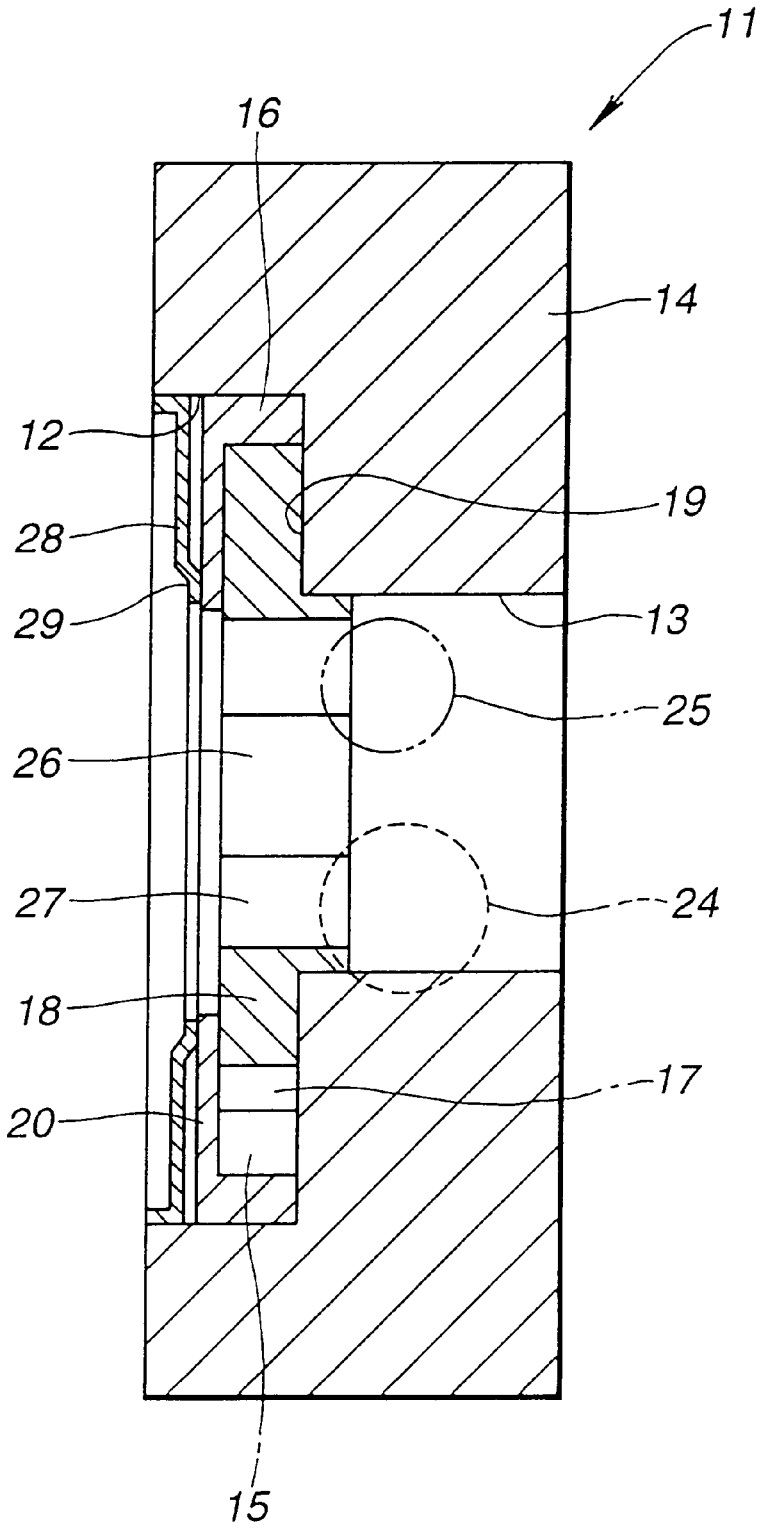
FIG. 3 is a view similar to FIG. 2, showing a second embodiment of the present invention.

FIG. 3 shows a second embodiment of the present invention that is substantially the same as the first embodiment except that a cup-like annular holding member 28 is press fitted in the larger diameter portion 12 for integration with the pump body 14. A stepped inner peripheral end 29 of the holding member 28 abuts on the inner periphery of the side plate 20 of the outer rotor 16. With such a structure, the inner periphery of the side plate 20 of the outer rotor 16 where the peripheral velocity is smaller is in slide contact with the inner peripheral end 29 of the holding member 28, enabling reduced wear of the two. Moreover, the side plate 20 abuts on the holding member 28 only on the inner peripheral end 29, having difficult occurrence of shearing of an oil film formed between the two in other portions, enabling reduced friction therebetween.

Figure 4:
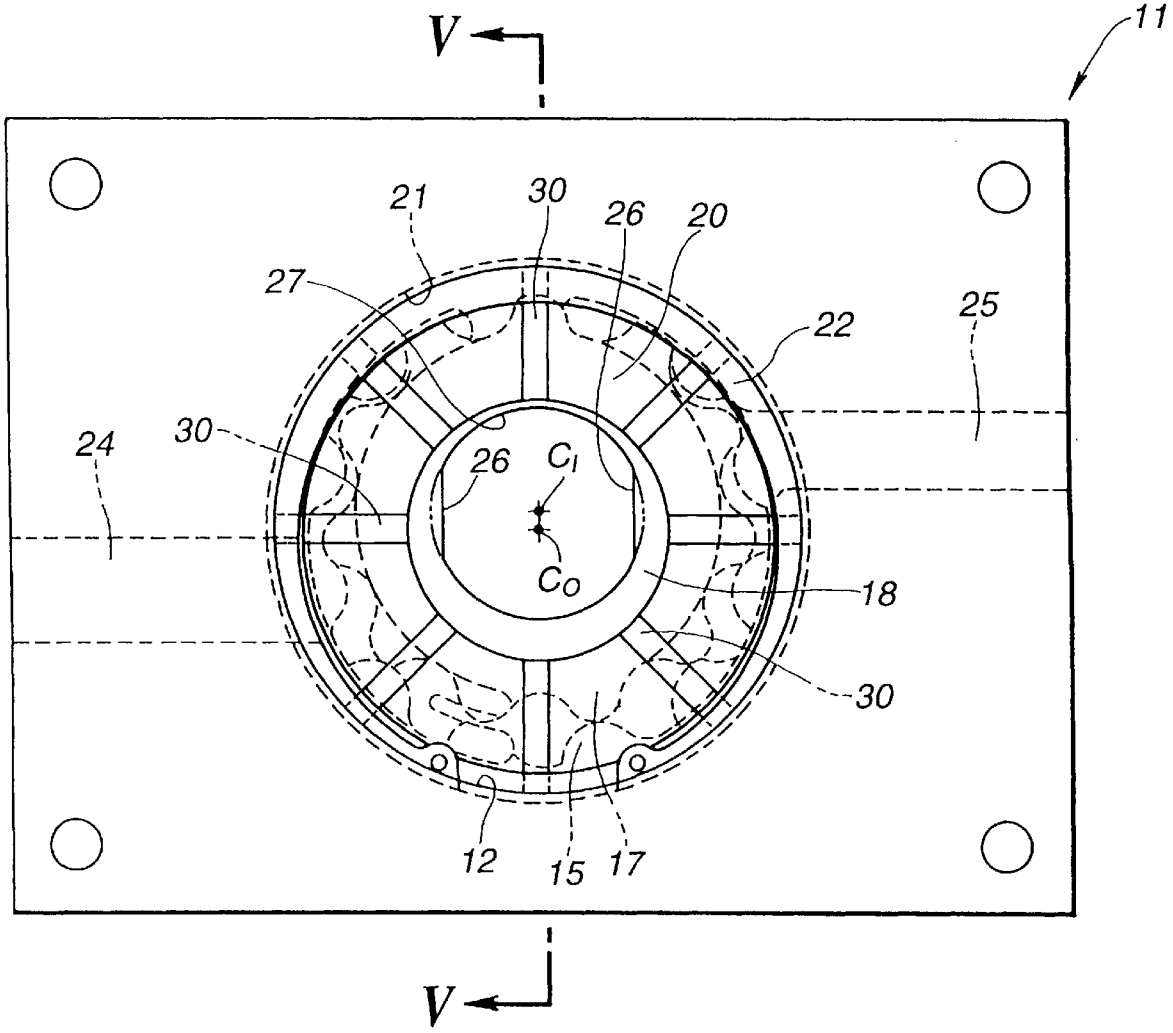
FIG. 4 is a view similar to FIG. 1, showing a third embodiment of the present invention.
Figure 5:
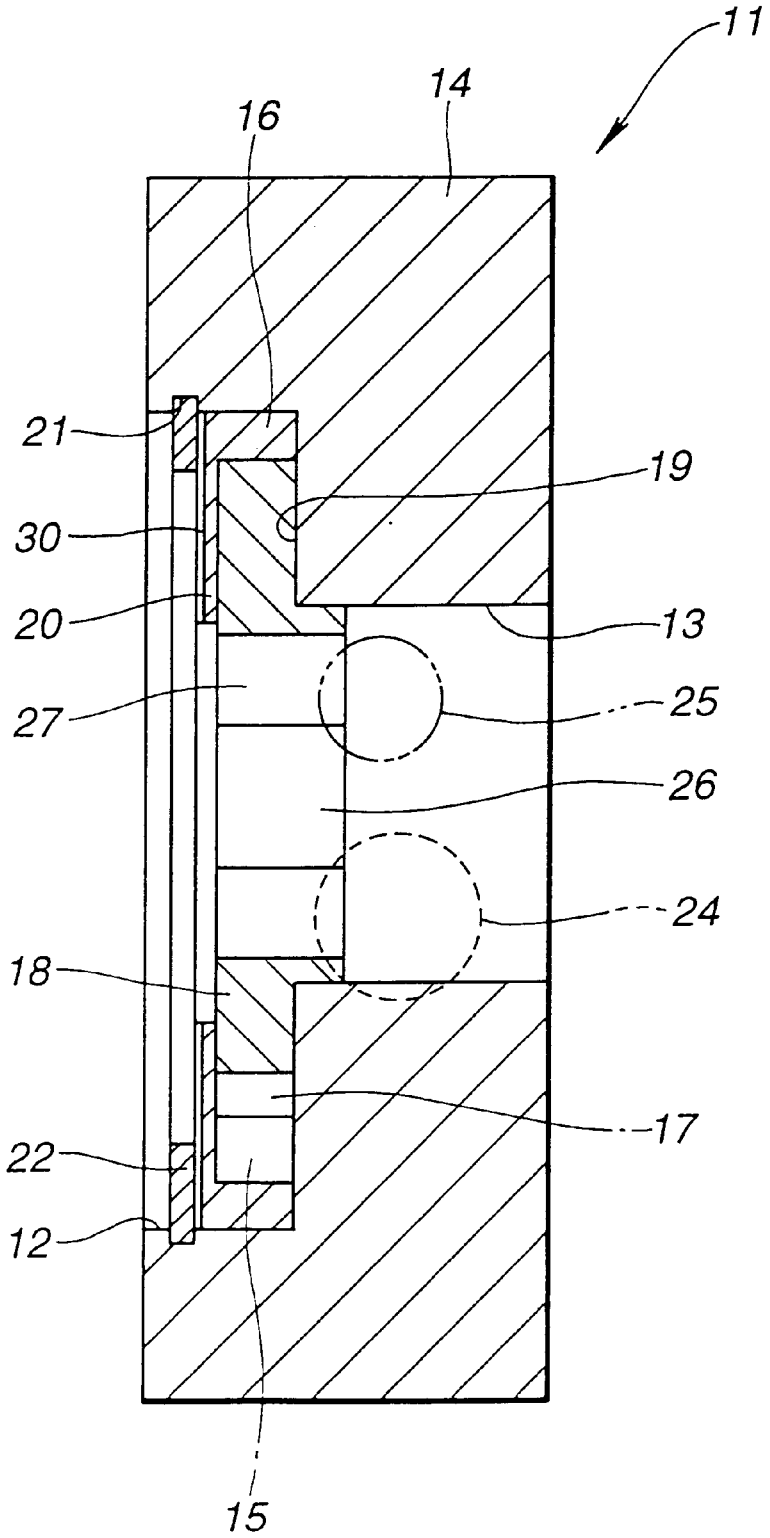
FIG. 5 is a view similar to FIG. 3, taken along the line V—V in FIG. 4.

FIGS. 4–5 show a third embodiment of the present invention that is substantially the same as the first embodiment except that lubricating grooves 30 are radially circumferentially equidistantly formed in an end face of the side plate 20 opposite to the snap ring 22. Lubricating oil leaking from the engaged portion of the outer and inner rotors 16, 18 with an increase in the discharge pressure flows into the lubricating grooves 30, which is supplied to a slide contact portion of the outer rotor 16 and the snap ring 22 by a centrifugal force produced by rotation of the outer rotor 16, resulting in reduced friction between the outer rotor 16 and the snap ring 22.

Figure 6:
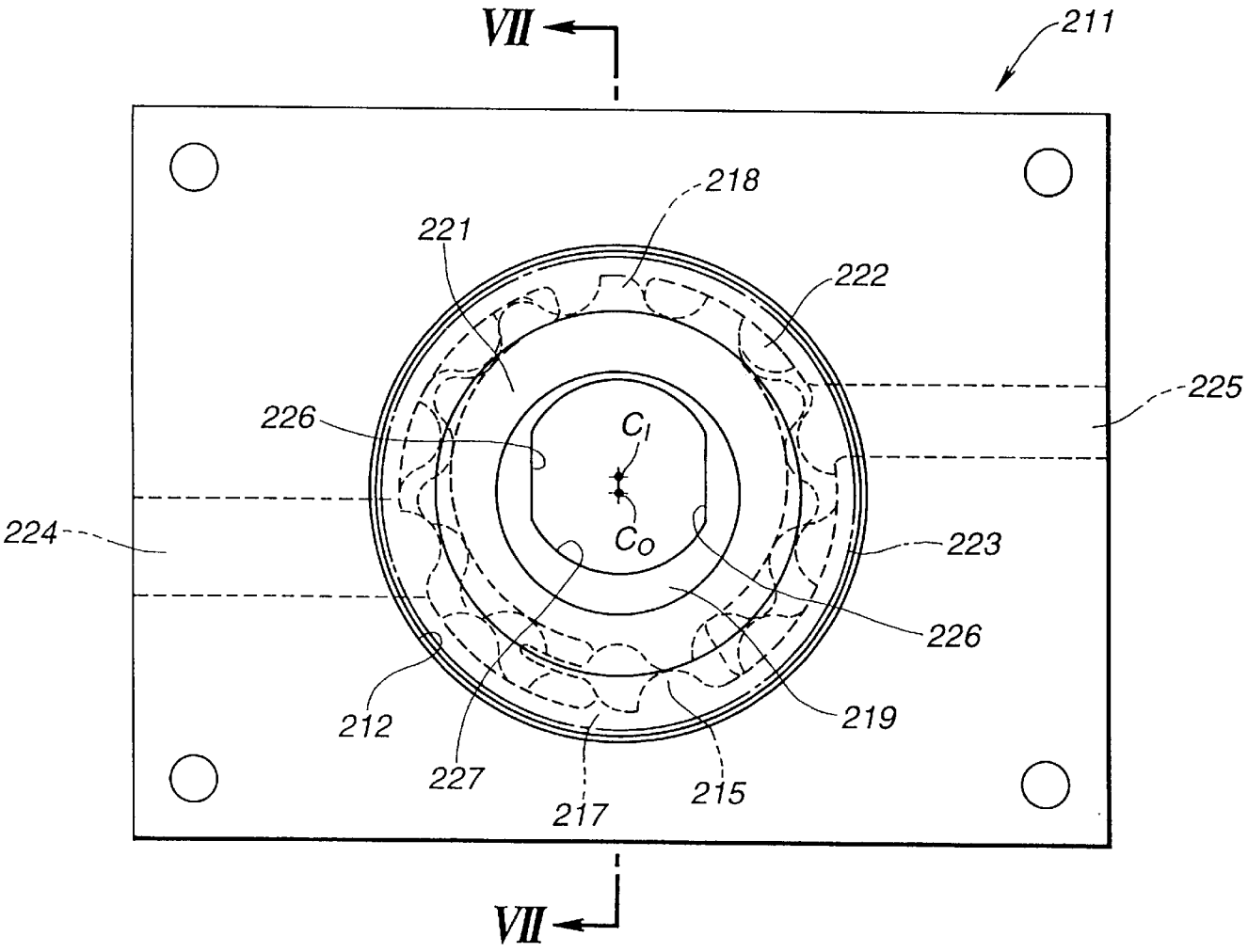
FIG. 6 is a view similar to FIG. 4, showing a fourth embodiment of the present invention.
Figure 7:
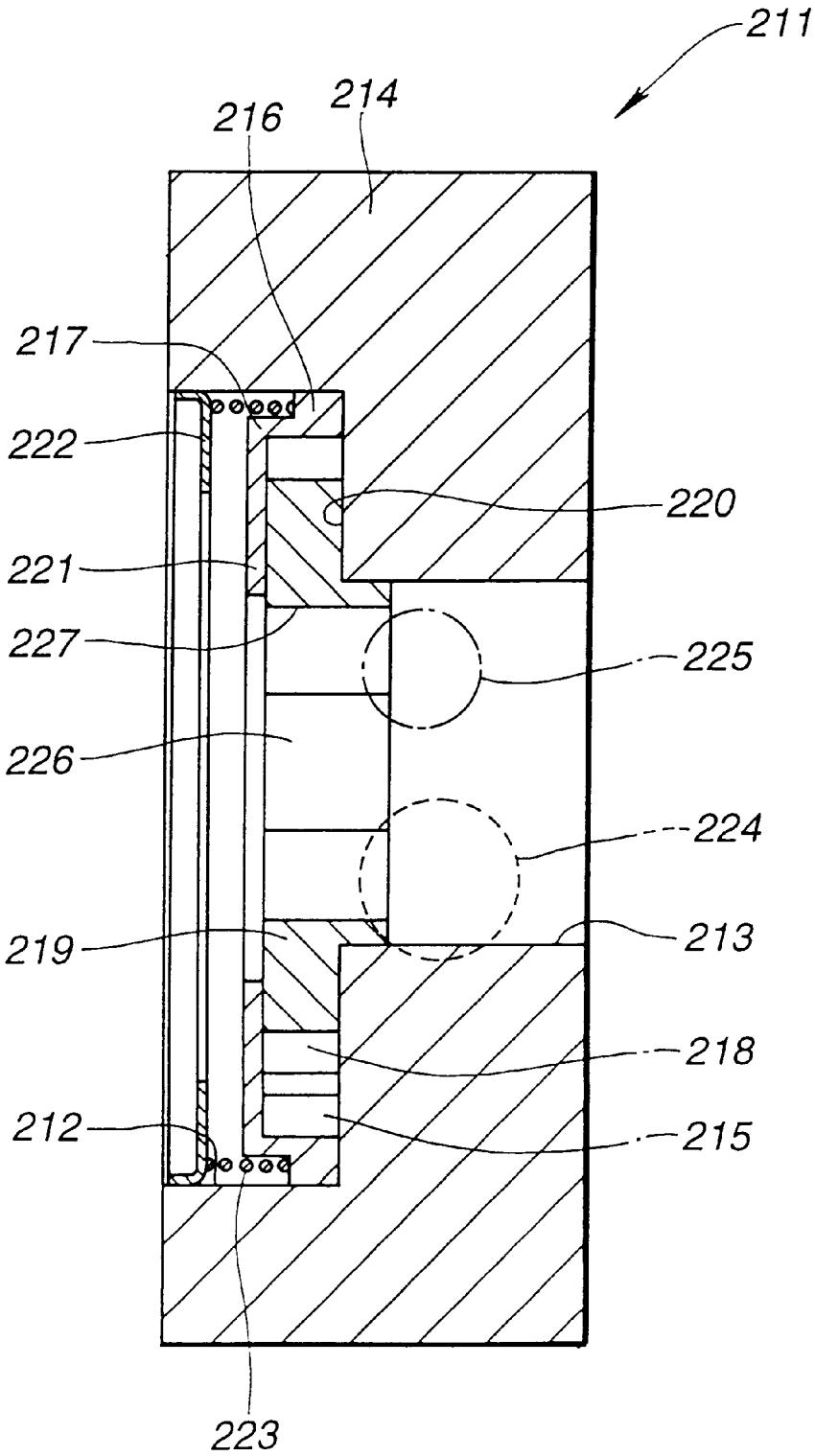
FIG. 7 is a view similar to FIG. 5, taken along the line VII—VII in FIG. 6.
Figure 8:
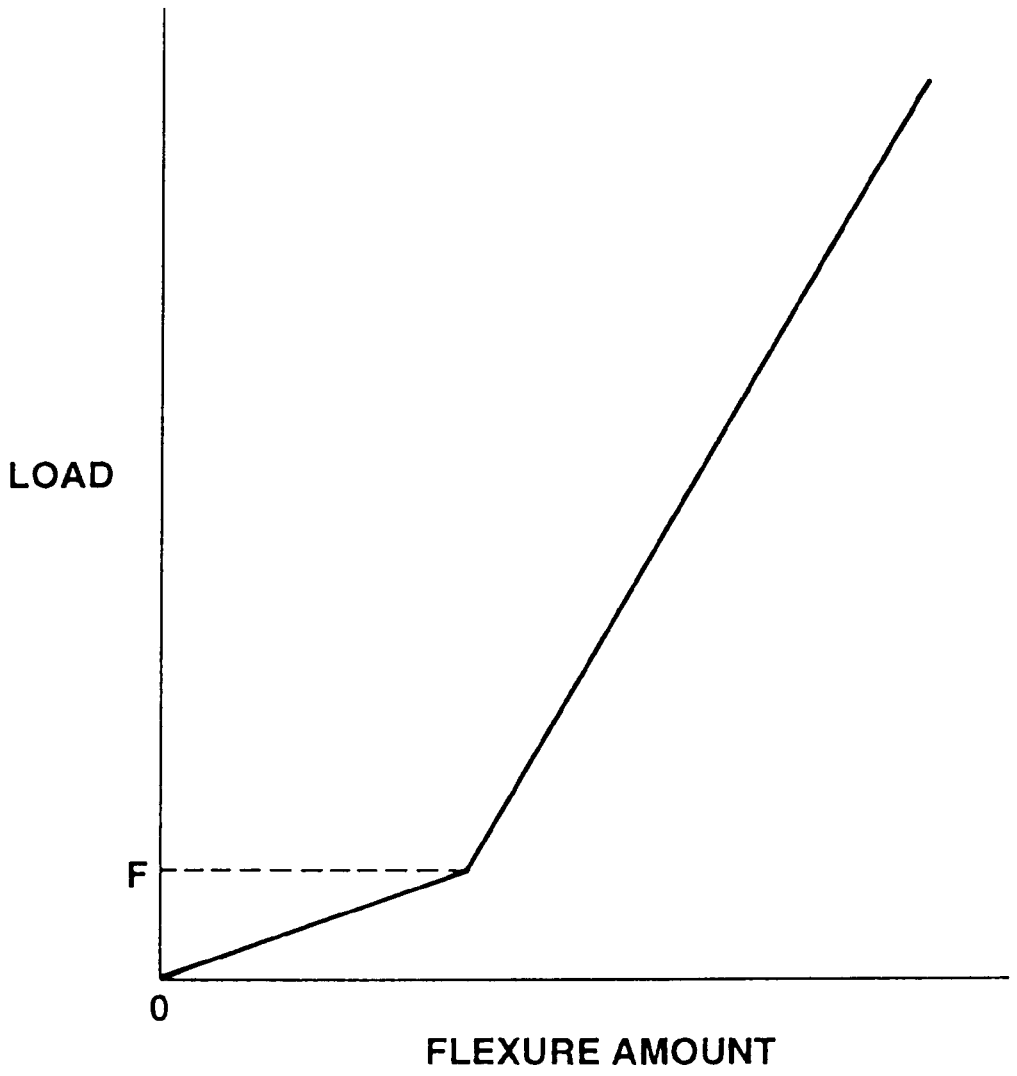
FIG. 8 is a graphical representation illustrating the relationship between the flexure amount of an irregular pitch coil spring and the load applied thereto.

FIGS. 6–8 show a fourth embodiment of the present invention. Referring to FIGS. 6–7, an internal gear pump comprises a pump housing 211 through which a crankshaft of a vehicular engine, not shown, is arranged. The pump housing 211 comprises a pump body 214 formed with a stepped hole having a larger diameter portion 212 and a smaller diameter portion 213, and a pump cover, not shown, integrated with the pump body 214 by means of fixing screws, not shown. It is noted that the pump cover is not an essential member in the present invention, and a structure with no pump cover may be adopted.

Rotatably supported by the larger diameter portion 212 of the stepped hole is an outer rotor 217 having an internal gear portion 215 and a flange portion 216 on the inner and outer peripheries, respectively. Rotatably supported by the smaller diameter portion 213 of the stepped hole eccentrically arranged with respect to the larger diameter portion 212 is an inner rotor 219 having an external gear portion 218 on the outer periphery, which is engaged with the internal gear portion 215 of the outer rotor 217. One side of each outer rotor 217 and inner rotor 219 abuts on a bearing surface 220 of the stepped hole. As is well known, the external gear portion 218 of the inner rotor 219 is smaller in the number of teeth than the internal gear portion 215 of the outer rotor 217. A rotation axis $C_O$ of the outer rotor 217 is eccentric to an rotation axis $C_I$ of the inner rotor 219 or the crankshaft.

Another side of the outer rotor 217 is integrally formed with an annular side plate 221 that can abut on another end face of the inner rotor 219. The inner rotor 219 is held by the side plate 221 and the bearing surface 220 of the stepped hole. An annular spring bearing 222 is press fitted in the larger diameter portion 212 of the stepped hole at the open end for integration with the pump body 214. An irregular pitch coil spring 223 as a resilient member is interposed between the spring bearing 222 and a side of the flange portion 216 of the outer rotor 217, and serves to press the side plate 221 of the outer rotor 217 on the another end face of the inner rotor 219.

In the fourth embodiment, the spring bearing 222 and the irregular pitch coil spring 223 constitute an inventive biasing device. Alternatively, the pump cover may be used as a spring bearing. In that case, it is unnecessary to press fit the spring bearing 22 in the larger diameter portion 212 of the stepped hole.

Referring to FIG. 8, in the fourth embodiment, the irregular pitch coil spring 223 is constructed so that the rate of increase of its flexure amount is changed when its load attains an initially set spring force F, i.e. the rate of change of the flexure amount is greater at a low load than at a high load. This can reduce a resistance when mounting the irregular pitch coil spring 223 and the spring bearing 222 to the larger diameter portion 212 of the pump body 214, resulting in improved assembling efficiency.

A suction port 224 and a discharge port 225 for hydraulic fluid, i.e. lubricating oil in the fourth embodiment, are formed in the pump body 214 in the opposite direction with respect to a plane including the rotation axes $C_O$, $C_I$ of the outer and inner rotors 217, 18 and along an engaged portion of the outer and inner rotors 217, 219. An engagement hole 227 having a modified cross section corresponding to the crankshaft, i.e. having a pair of flat surfaces 226, is formed in the center of the inner rotor 219 engaged with the crankshaft for unitary rotation.

Therefore, when the inner rotor 217 is driven counterclockwise as shown in FIG. 6 through the crankshaft, the outer rotor 217 is driven together, which has the internal gear portion 215 engaged with the external gear portion 218 of the inner rotor 219. By this, lubricating oil within the suction port 224 is successively fed into the discharge port 225 through a clearance formed between the external gear portion 218 of the inner rotor 219 and the internal gear portion 215 of the outer rotor 217.

In that case, since the discharge pressure of lubricating oil is lower upon lower rotation of the crankshaft, the outer rotor 217 is biased to the pump body 214 by a spring force of the irregular pitch coil spring 223. Thus, predetermined side clearances are preserved between the bearing surface 220 and the one side of each outer rotor 217 and inner rotor 219, and between the side plate 221 of the outer rotor 217 and the another end face of the inner rotor 219, respectively, ensuring ordinary discharge performance. On the other hand, when the discharge pressure of lubricating oil, which becomes greater with an increase in rotation of the crankshaft, exceeds the initially set spring force F of the irregular pitch coil spring 223, the outer rotor 217 is displaced, against a spring force of the irregular pitch coil spring 223, to the spring bearing 222 by the displacement amount proportional to the discharge pressure. This increases the side clearances with respect to their initial values, increasing the leakage amount of lubricating oil and decreasing the discharge amount thereof out of the discharge port 225, preserving a predetermined discharge pressure.

Lubricating oil leaking from the side clearances passes through a clearance between the smaller diameter portion 213 and the inner rotor 219, which is temporarily accumulated in an oil seal chamber, not shown, formed between the crankshaft and the pump body 214, then returned to an oil pan, not shown, through a drain hole, not shown, communicating with the oil seal chamber.

Having described the present invention with regard to the preferred embodiments, it is noted that the present invention is not limited thereto, and various changes and modifications can be made without departing from the scope of the present invention.

What is claimed is:

1. An internal gear pump, comprising:

a housing;

an outer rotor rotatably accommodated in said housing, said outer rotor including an internal gear portion on an inner periphery thereof;

an inner rotor rotatably accommodated in said housing, said inner rotor being eccentrically disposed with respect to said outer rotor, said inner rotor including an external gear portion on an outer periphery thereof, said external gear being engaged with said internal gear portion of said outer rotor;

a side plate integrated with said outer rotor, said side plate abutting on a side of said inner rotor, said side failing to be in glide contact with said housing; and a holding device mounted to said housing, said holding device restricting a position of said outer rotor with respect to said housing.

2. An internal gear pump as claimed in claim 1, wherein said holding device is in slide contact with said side plate on an inner periphery thereof.

3. An internal gear pump as claimed in claim 2, wherein said holding device includes a coating layer of synthetic resin, a thrust washer, and a thrust bearing.

4. An internal gear pump as claimed in claim 1, further comprising a friction reducing member interposed between said side plate and said holding device.

5. An internal gear pump as claimed in claim 1, wherein said side plate has grooves formed in said side plate in a side thereof that is in slide contact with said holding device.

6. An internal gear pump as claimed in claim 1, wherein said holding device includes a resilient member having one end abutting on said outer rotor and a spring bearing fixed to said housing and abutting on another end of said resilient member.

7. An internal gear pump, comprising:

a housing;

an outer rotor rotatably accommodated in said housing, said outer rotor including an internal gear portion on an inner periphery thereof;

an inner rotor rotatably accommodated in said housing, said inner rotor being eccentrically disposed with respect to said outer rotor, said inner rotor including an external gear portion on an outer periphery thereof, said external gear being engaged with said internal gear portion of said outer rotor;

a side plate integrated with said outer rotor, said side plate abutting on a side of said inner rotor, said side failing to be in slide contact with said housing; and means, mounted to said housing, for restricting a position of said outer rotor with respect to said housing.

* * * * *